United States Patent [19]

Oinonen

[11] Patent Number: 4,598,877

[45] Date of Patent: Jul. 8, 1986

[54] APPARATUS FOR WINDING WEB MATERIAL ON A TUBULAR CORE

[75] Inventor: Hannu Oinonen, Järvenpää, Finland

[73] Assignee: Oy Wartsila AB, Finland

[21] Appl. No.: 721,398

[22] Filed: Apr. 9, 1985

[30] Foreign Application Priority Data

Apr. 11, 1984 [FI] Finland ..... 841448

[51] Int. Cl.[4] ..... B65H 18/20

[52] U.S. Cl. ..... 242/66

[58] Field of Search ..... 242/66, 65, 75.1

[56] References Cited

U.S. PATENT DOCUMENTS

| | | | |
|---|---|---|---|
| 3,720,381 | 3/1973 | Rehme | 242/66 X |
| 3,869,095 | 3/1975 | Diltz | 242/66 X |
| 4,327,877 | 5/1982 | Perini | 242/66 |
| 4,465,243 | 8/1984 | Welp | 242/66 |
| 4,508,283 | 4/1985 | Beisswanger | 242/66 X |

*Primary Examiner*—John M. Jillions

*Attorney, Agent, or Firm*—Steinberg & Raskin

[57] ABSTRACT

Apparatus for winding web material, such as a paper web, on a tubular core to obtain a web roll includes a first carrier roll forming a first nip with the web roll, a second carrier roll forming a second nip with the web roll, at least one of the first and second carrier rolls being driven to rotate the tubular core and web roll being wound thereon, and a weight roll acting on the web roll with a press force. The first and second carrier rolls and weight roll are arranged asymmetrically with respect to each other such that the weight of the web roll acts on the second nip and the tension of the web material being wound is determined by the magnitude of the component of the press force applied by the weight roll acting on the first nip. The web material is disposed to run onto the core tube through a space between the first and second carrier rolls and through the first nip.

9 Claims, 1 Drawing Figure

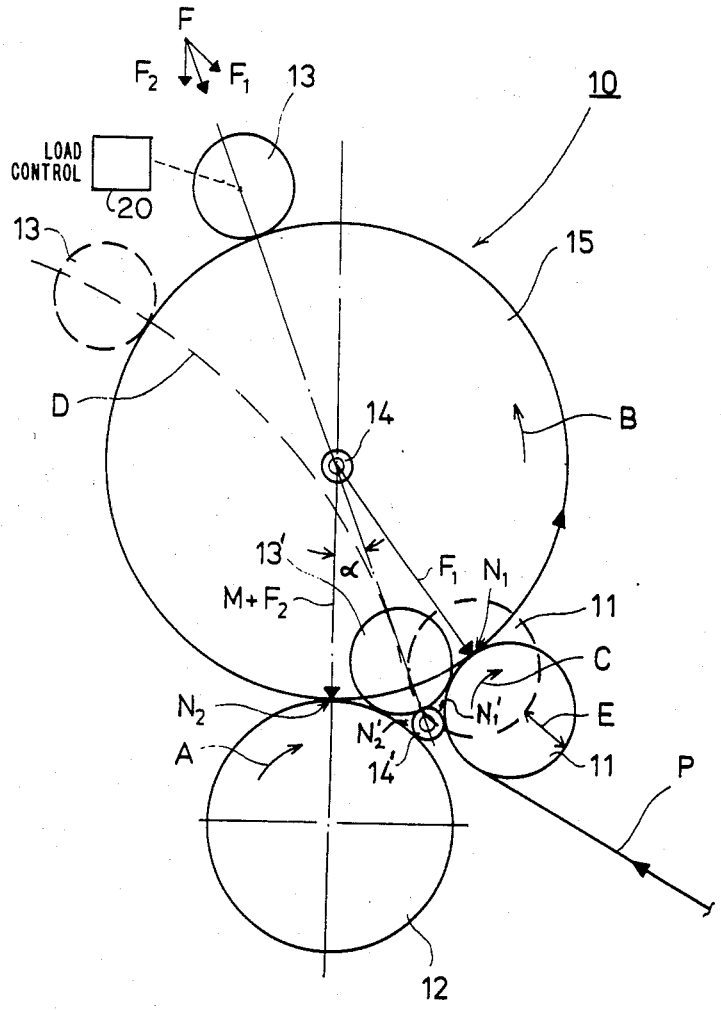
F
$F_2$
$F_1$
13
10
LOAD CONTROL
20
13
15
D
14
B
13'
α
$F_1$
$N_1$
$M+F_2$
11
C
$N_2$
$N_1'$
E
$N_2'$
A
14'
11
P
12

APPARATUS FOR WINDING WEB MATERIAL ON A TUBULAR CORE

BACKGROUND OF THE INVENTION

The present invention relates generally to apparatus for winding web material, such as a paper web, on a tubular core to obtain a web roll.

In particular, the invention relates to an improvement in web material winding apparatus which includes a first carrier roll forming a first nip with the web roll, a second carrier roll forming a second nip with the web roll, a weight roll acting on the web roll with a press force, and wherein at least one of the first and second carrier rolls is a driven roll for rotating the tubular core and the web roll wound thereon.

The greatest drawback in conventional web material winding apparatus of this type is that it is difficult to control the tension of the web material during the winding process. In particular, it is necessary to increase the tension of the web material at the beginning of the winding operation so that the inner portion of the web roll being formed will not be too soft to withstand the effects of the more tautly wound outer portion of the roll produced at a later stage of the operation. If the inner portion of the web roll is too soft, the forces exerted on it by the outer roll portion will cause so-called puckers to be formed in the wound web roll.

Arrangements are known in the art wherein the hardness of a web roll is controlled during the winding operation. In one such arrangement, the web roll is carried on two parallel carrier rolls, the load from the web roll being divided between the carrier rolls. To this end, carrier rolls having substantially the same diameters can be disposed at different horizontal levels or, alternatively, carrier rolls having different diameters can be used. It is also known in the art that a harder wound web roll is obtained when the winding is performed on a carrier roll having a smaller diameter than in the case where the winding is performed on the carrier roll with a larger diameter.

Regarding the state of the art, reference is made to Finnish Patent Application No. 820383, corresponding to U.S. Pat. No. 4,465,243, in which an arrangement for centerless winding of web material is disclosed. In that arrangement the web is subjected to a substantially uniform tension until the web roll being wound reaches a certain size. As the size of the web roll increases, the puckering o pinching described above becomes unavoidable.

SUMMARY OF THE INVENTION

Accordingly, it is an object of the present invention to provide new and improved apparatus for winding web material, such as paper web.

Another object of the present invention is to provide new and improved web material winding apparatus including first and second carrier rolls forming corresponding first and second nips with the web roll being wound and a weight roll acting on the web roll.

Still another object of the present invention is to provide new and improved web material winding apparatus wherein the tension on the web material during the winding operation is reliably controlled in a simple manner so that objectionable tautness of the web layers of the web roll due to the weight of the web roll will be avoided when the operation is performed on a carrier roll.

Briefly, in accordance with the present invention these and other objects are attained by providing an improvement in the web material winding apparatus described above, namely, the carrier rolls and weight roll are disposed asymmetrically with respect to each other so that the weight of the web roll being wound acts on the second nip formed by the web roll and second carrier roll, the tension or tightness of the web material of the web roll being wound is determined by the magnitude of the component of the press force from the weight roll directed on the first nip, and that the web material is disposed to run onto the tubular core through a space provided between the carrier rolls and through the first nip.

As noted, the carrier rolls and the weight roll in apparatus in accordance with the invention are disposed asymmetrically with respect to each other in a manner such that the weight of the web roll being wound acts on the second nip defined by the second carrier roll and the web roll being wound. Of course, a component of the press force from the weight roll acting on the web roll will also act on the second nip. Furthermore, the tension in the web roll being wound is exclusively and solely determined by the magnitude of the component of the press force from the weight roll which is directed on the first nip defined by the first carrier roll and the web roll being wound.

The arrangement in accordance with the invention makes it possible to maintain the web material being wound on the web roll at the beginning of the winding operation under greater tension or tautness to achieve a desired compactness of the inner portion of the web roll being wound. As the winding progresses, the press force provided by the weight roll may be altered so that a desired tension can be achieved even in the outer portion of the web roll. For example, the nip pressure acting in the first nip can be reduced or even eliminated (nip pressure reduced to zero) so that a roll of web material being wound on apparatus in accordance with the invention can have a desired tension in the web throughout its entire thickness thereby avoiding any risk of the possibility of so-called puckers being formed in the web material being wound.

DETAILED DESCRIPTION OF THE DRAWING

A more complete appreciation of the present invention and many of the attendant advantages thereof will be readily understood by reference to the following detailed description when considered in connection with the accompanying drawing in which the sole FIGURE is a schematic elevation view of apparatus in accordance with the invention.

DESCRIPTION OF PREFERRED EMBODIMENTS

Referring now to the drawing, winding apparatus in accordance with the invention, generally designated 10, comprises a first carrier roll 11, a second carrier roll 12 and a weight roll 13. Web material P, such as a paper web, is wound on a tubular core 14 to form a web roll 15.

The first carrier roll 11 forms a first nip $N_1$ with the web roll 15, the second carrier roll 12 forms a second nip $N_2$ with the web roll and the weight roll 13 acts on the web roll 15 with a press force F. At least one of the two carrier rolls 11, 12 is driven and acts to rotate the tubular core 14 and the web roll 15 wound thereon. In the illustrated embodiment, the larger second carrier roll 12 is driven to rotate the tubular core 14 and the web roll 15. However, it is understood that it may be advantageous in certain applications to provide a separate drive for both of the carrier rolls 11 and 12 in which case it becomes possible to use the carrier rolls 11 and 12 separately to increase or decrease the tension of the web layers of the web roll 15 such, for example, in accordance with a predetermined program.

The tubular core and weight roll prior to initiation of the winding operation are designated 14' and 13' respectively. The first and second nips $N_1$ and $N_2$ prior to initiation of the winding operation are designated $N_1'$ and $N_2'$.

The arrow A in the drawing indicates the direction of rotation of the larger second carrier roll 12, the arrow B indicates the direction of rotation of the web roll 15 being wound on the tubular core 14, and the arrow C indicates the direction of rotation of the smaller first carrier roll 11. The second carrier roll 12 has a larger diameter than the first carrier roll 11 and, preferably, has a diameter which is in the range of about 1.5 to 4 times that of the first carrier roll 11.

In accordance with the basic principle of the invention, the carrier rolls 11 and 12 and the weight roll 13 are disposed asymmetrically with respect to each other in a manner such that the weight, designated M, of the web roll 15 being wound on the tubular core 14 and the component, designated $F_2$, of the press force F applied on the web roll 15 by the weight roll 13, acts on the second nip $N_2$. Secondly, according to the basic principle of the invention, the tension of the web being wound onto the web roll 15 is determined by the magnitude of the component $F_1$ of the component of the press force F applied on the web roll 15 by the weight roll 13 which is directed on the first nip $N_1$. The pressure in the nip $N_1$ is regulated by the loading of the weight roll 13 by an appropriate load control, schematically illustrated at 20. The manner in which such loading is applied is conventional and may comprise, for example, a load control 20 including power-cylinder arrangement. The direction of the press force F applied to and which acts on the web roll 15 by the weight roll 13 forms an angle $\alpha$ with the direction of the weight M of the web roll 15 acting on the nip $N_2$. The magnitude of the angle $\alpha$ is preferably in the range of between about 20 to 30 degrees.

The arrangement shown in the drawing is obtained by choosing the angle $\alpha$ so that the weight of the completed web roll 15, the diameter of which is chosen in advance, is directed only on the nip $N_2$.

The weight roll 13 may be mounted for movement along a substantially circular path, designated by the dashed line D, as the diameter of the web roll 15 increases so that the tendency for the weight roll 13 to keep the web roll 15 supported by the carrier rolls 11 and 12 is enhanced.

As seen in the drawing, the web material P is conducted onto the tubular core 14 through a space provided between the first and second carrier rolls 11 and 12 and through the nip $N_1$ on which the "static component" $M+F_2$ of the weight M of the web roll 15 and the component $F_2$ of the force F applied by the weight roll 13 does not act. In the case where the carrier rolls are provided with their own respective drives, the smaller first carrier roll 11 rotates at a speed $V_{11}$ which is smaller than the speed of rotation $V_{12}$ of the larger second carrier roll 12. In this manner it is possible to produce a controlled tension in the nip $N_1$ with the aid of the loading imposed by the weight roll 13.

As the diameter of the web roll 15 increases during winding, the nip pressure exerted on the nip $N_2$ naturally increases. This increase in nip pressure would otherwise have a disadvantageous affect on the paper web P if the web were conducted through the nip $N_2$. Therefore, as the diameter of the web roll 15 increases during winding, the nip pressure acting on the nip $N_1$ must correspondingly decrease so that a uniform tension is achieved throughout the web roll 15 being wound.

It may be desirable in some cases to mount the first carrier roll 11 for movement with respect to the carrier roll 12 as shown by the arrow E in the drawing as the web roll 15 increases in size so that the weight M of the web roll 15 will act exclusively on the second nip $N_2$. Carrier roll 11 can also move downwardly from the position shown in the drawing or may be stationary if the geometry of the arrangement is chosen so that the desired final configuration is achieved. It should also be noted that carrier roll 12 may be movably mounted to achieve the desired final result.

Obviously, numerous modifications and variations of the present invention are possible in the light of the above teachings. It is therefore to be understood that within the scope of the claims appended hereto, the invention may be practiced otherwise than as specificall disclosed herein.

What is claimed is:

1. In apparatus for winding a tensioned web material, such as a paper web, on a tubular core to obtain a web roll wound on said tubular core, the apparatus including a first carrier roll forming a first nip with the web roll, a second carrier roll forming a second nip with the web roll, a weight roll acting on the web roll with a press force, and wherein at least one of said first and second carrier rolls is a driven roll for rotating said tubular core and the web roll wound thereon, the improvement comprising:

load control means for pressing said weight roll against said web roll to apply a press force thereon, the magnitude of the press force being selectively variable;

said first carrier roll being positioned such that a nip pressure acting in said first nip formed between said first carrier roll and said web roll is determined by the magnitude of the component of the press force applied on said web roll by said weight roll, said nip pressure in said first nip being variable from substantially zero to a miximum;

said second carrier roll being positioned such that said first and second carrier and weight rolls are arranged asymmetrically with respect to each other with the weight of the web roll acting on said second nip formed between said web roll and said second carrier roll;

said web material is disposed to run onto the core tube through a space between said first and second carrier rolls and through said first nip; and wherein the tension of the web material being wound is determined solely by the magnitude of the component of the press force applied on said web roll by said weight roll which acts on said first nip formed between said web roll and said first carrier roll.

2. The combination of claim 1 wherein the diameter of said second carrier roll is larger than the diameter of said first carrier roll.

3. The combination of claim 2 wherein the diameter of said second carrier roll is in the range of between about 1.5 to 4 times larger than the diameter of said first carrier roll.

4. The combination of claim 1 wherein said first carrier roll is mounted for movement with respect to said second carrier roll as the web roll increases in size so that the weight of the web roll acts exclusively on said second nip.

5. The combination of claim 1 wherein said second carrier roll is said driven roll.

6. The combination of claim 1 wherein both of said first and second carrier rolls are driven rolls which are separately driven.

7. The combination of claim 1 wherein the direction of the press force acting on the web roll by said weight roll forms an angle with the direction of the weight of the web roll.

8. The combination of claim 7 wherein said angle is in the range of between about 20 to 30 degrees.

9. The combination of claim 1 wherein said weight roll is mounted for movement along a substantially circular arc shaped path as the web roll increases in size.

* * * * *